US006142164A

United States Patent [19]

Wier et al.

[11] Patent Number: 6,142,164

[45] Date of Patent: Nov. 7, 2000

[54] METHOD AND APPARATUS FOR REMOVING LEAKING GAS IN AN INTEGRATED GAS PANEL SYSTEM

[75] Inventors: Bruce C. Wier, San Jose; Akira Muraoka, Menlo Park; Charles K. Lokey, Palo Alto, all of Calif.

[73] Assignee: Ultra Clean Technology Systems & Service, Inc., Menlo Park, Calif.

[21] Appl. No.: 09/037,390

[22] Filed: Mar. 9, 1998

[51] Int. Cl.[7] ..... B08B 5/02; B08B 5/04; B08B 9/035

[52] U.S. Cl. ..... 137/15.04; 134/21; 134/22.11; 134/94.1; 134/98.1; 134/169 C; 137/240; 137/312; 137/565.01; 137/565.03; 137/597; 137/884

[58] Field of Search ..... 137/238, 240, 137/597, 884, 312, 15.04, 565.01, 565.03; 134/1.3, 21, 22.11, 98.1, 166 C, 169 C, 95.1, 94.1

[56] References Cited

U.S. PATENT DOCUMENTS 4,842,683 6/1989 Cheng et al. ..... 156/345
5,000,113 3/1991 Wang et al. ..... 118/723
5,163,475 11/1992 Gregoire ..... 137/597
5,313,982 5/1994 Ohmi et al. ..... 137/597
5,329,463 7/1994 Sierk et al. ..... 364/510

*Primary Examiner*—George L. Walton
*Attorney, Agent, or Firm*—Jeffery D. Frazier; LeeAnn Gorthey

[57] ABSTRACT

One aspect of the present invention provides an apparatus which permits the efficient purging of leaked process gas at the component-panel interface in an integrated gas panel system. The apparatus provides conduit structure for directing a flow of purging gas through a surface interface whereat a gas-manifold panel meets gas-manifold components. A further aspect of the invention provides a method for efficiently purging process gas which might leak out at the component-panel interface in an integrated gas panel system. The method includes the step of simultaneously directing a stream of purging gas along a pathway extending over the surface interface and along a pathway which intersects and passes through the surface interface.

16 Claims, 9 Drawing Sheets

METHOD AND APPARATUS FOR REMOVING LEAKING GAS IN AN INTEGRATED GAS PANEL SYSTEM

FIELD OF THE INVENTION

The present invention relates to an integrated gas panel system for delivering process gas to a tool location. More particularly, it relates to an improved method and apparatus for removing gas leaking from components mounted on the surface of a panel in such a system.

BACKGROUND OF THE INVENTION

Gas delivery systems for semiconductor processing equipment are the subject of stringent safety regulations. For example, SEMI Spec. S2-93, as well as various local ordinances, require that Hazardous Process Material (HPM) gases be enclosed in a secondary confinement and that the confinement be swept with air at a specified velocity, depending on the type of gas in the system.

Early gas delivery systems were rather large. Such early systems typically included various tubing connections extending between process gas holding tanks and tooling stations. More recent gas delivery systems have been made smaller and more compact by implementing various design changes. For instance, the use of tubing connections to carry process gas has been greatly reduced in some systems. Instead, passageways for process gas are drilled directly into a solid block of metal, often referred to as a panel. Components, such as valves, filters, mass flow controllers, and the like, are then mounted on the surface of the panel. By stacking such components together, a dense package is formed. Systems of this type are commonly referred to as "integrated gas panel systems" (IGP) or "integrated gas systems" (IGS).

In spite of the advantages offered by integrated gas panel systems, certain undesirable features have arisen. Particularly, the densely packaged components on the panel surface can present an impediment to the flow of purging gas. Thus, it has become difficult to efficiently purge leaked process gas residing along the component-panel interface.

As indicated above, in prior attempts at removing leaked process gas, a stream of purging gas (usually air) has been directed through the confinement enclosure over the surface interface whereat the panel meets the various components. In some constructions, fins have been utilized to assist in localizing the purging gas flow. When servicing the confinement enclosure, however, the flow is disrupted by the change in pressure caused by the door being open. In this condition, leaked process gas could flow out of the confinement enclosure through the open door.

Other conventional methods use spraying devices, as well as fans, to localize flow. But these, too, suffer from inadequate removal of leaked process gas, as well as loss of leaked process gas to the external environment when the confinement structure's door is opened.

It is, therefore, an object of this invention to provide an improved apparatus which permits the efficient purging of leaked process gas at the component-panel interface in an integrated gas panel system.

It is also an object of this invention to provide a method for efficiently purging process gas which might leak out at the component-panel interface in an integrated gas panel system.

SUMMARY OF THE INVENTION

The present invention provides an improved apparatus for removal and dilution of gas which may leak from an integrated gas panel system for delivering process gas to semiconductor processing equipment. The integrated gas panel system includes a containment enclosure and a gas-manifold panel mounted within the containment enclosure, wherein the gas-manifold panel participates in the regulation, metering, mixing, and carrying of the process gas. The integrated gas panel system also includes gas-manifold components mounted upon the gas-manifold panel, and a surface interface whereat the gas-manifold components meet the gas-manifold panel. Process gas which may leak from the gas-manifold components is removed by directing a stream of purging gas along a pathway extending over the surface interface. The improvement of the present invention provides, in addition to the above, a chamber and a conduit structure. The conduit structure is formed in the gas-manifold panel. The conduit structure is employed to direct a purging gas to or from the chamber along a pathway which intersects and passes through the surface interface.

The present invention also provides a method of removing process gas leaking from an integrated gas panel system for delivering process gas in semiconductor processing equipment. The method is used in connection with an integrated gas panel system which includes a containment enclosure and a gas-manifold panel mounted within the containment enclosure, wherein the gas-manifold panel participates in the carrying of the process gas. The integrated gas panel system further including gas-manifold components mounted upon the gas-manifold panel, and a surface interface whereat the gas-manifold components meet the gas-manifold panel. The method comprises the step of simultaneously directing a stream of purging gas along a pathway extending over the surface interface and along a pathway which intersects and passes through the surface interface.

These and other features and advantages of the present invention will become clear from the following description.

BRIEF DESCRIPTION OF THE FIGURES

The structure and manner of operation of the invention, together with the further objects and advantages thereof, may best be understood by reference to the following description taken in conjunction with the accompanying drawings, in which identical reference numerals identify similar elements, and in which.

DETAILED DESCRIPTION OF THE INVENTION

One aspect of the present invention provides an apparatus intended for use in an integrated gas panel system for delivering process gas to semiconductor processing equipment. The apparatus may find particular utility in the control of the high-purity gases used in the processing of semiconductor devices. As detailed below, the apparatus embodies features which permit the efficient removal of process gas leaking along a surface interface whereat gas-manifold components meet the surface of a gas-manifold panel.

Figure 1:
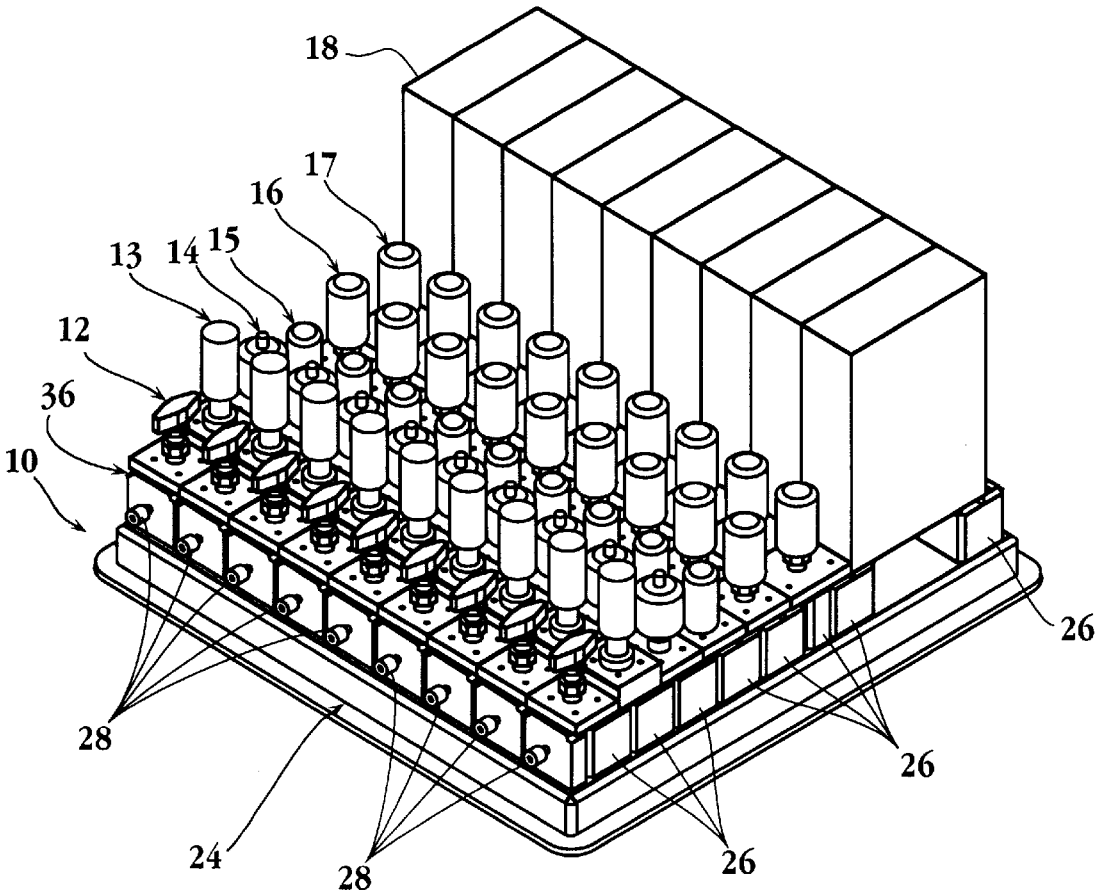
FIG. 1 is a perspective view showing components of a gas panel apparatus constructed in accordance with an embodiment of the present invention.

Referring now in detail to the drawings, FIG. 1 shows, in perspective view, components of a gas panel apparatus constructed in accordance with an embodiment of the present invention. The major components include a gas-manifold panel, indicated generally by the reference numeral 10, having various gas-manifold components, 12, 13, 14, 15, 16, 17 and 18, mounted upon one surface, and a plenum structure 24 located adjacent the other surface.

Figure 2:
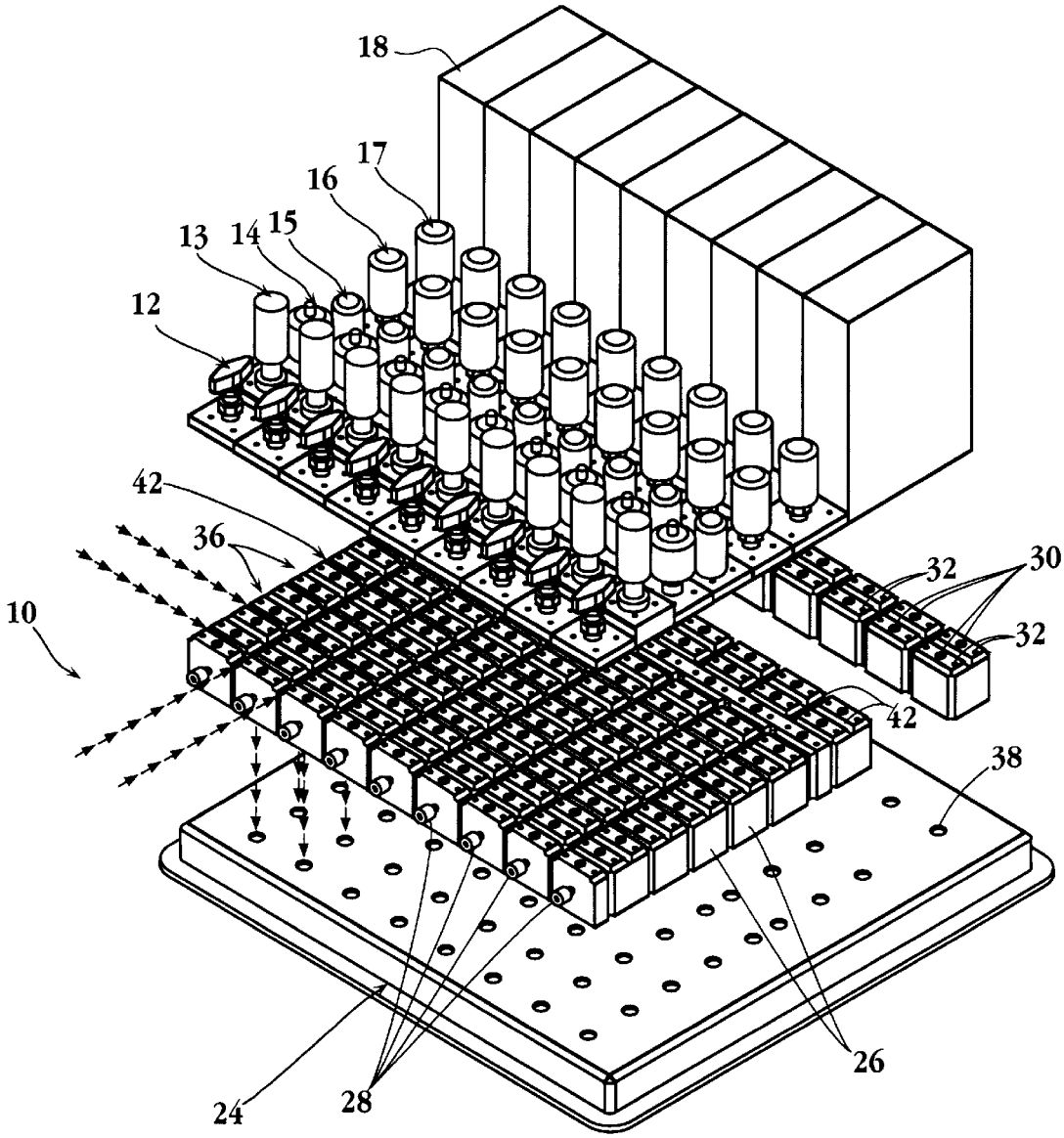
FIG. 2 is an exploded view showing additional details of the gas panel apparatus of FIG. 1.
Figure 3A:
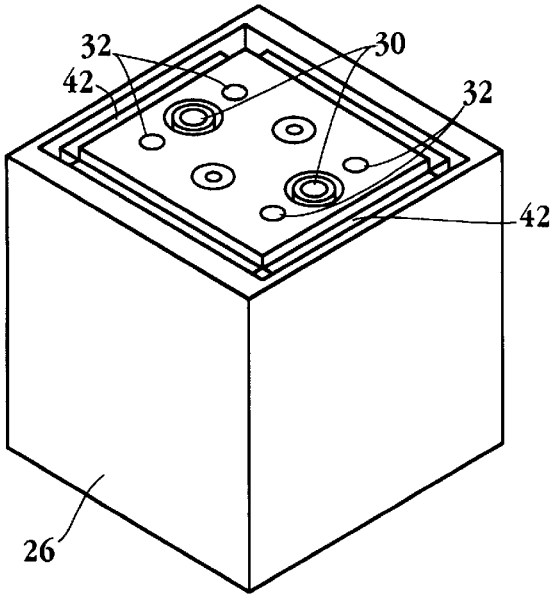
FIG. 3A is a perspective view showing one embodiment of an individual panel block which is suitable for use in constructing the gas-manifold panel of the present invention.
Figure 3B:
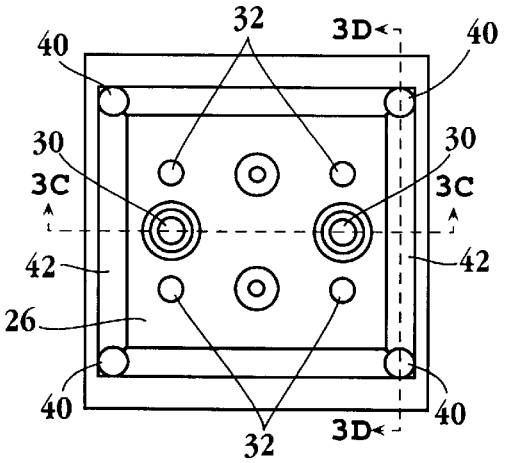
FIG. 3B is a top plan view of the individual panel block shown in FIG. 3A.
Figure 3C:
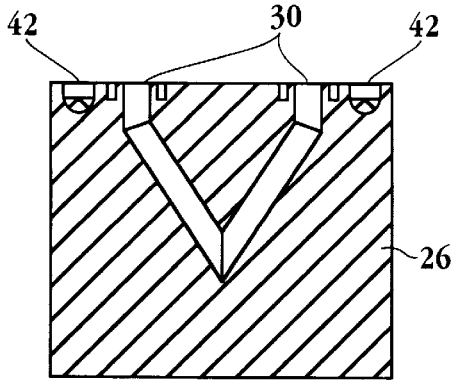
FIG. 3C is a cross-sectional view taken along the line A—A of FIG. 3B.
Figure 3D:
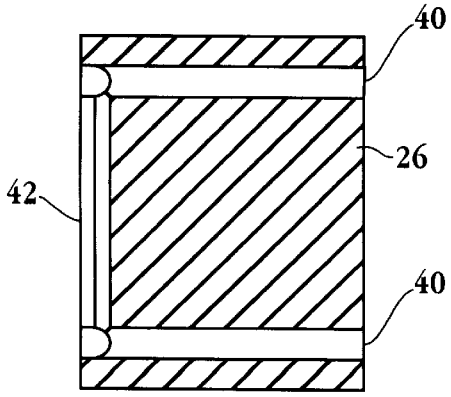
FIG. 3D is a cross-sectional view taken along the line B—B of FIG. 3B.
Figure 6A:
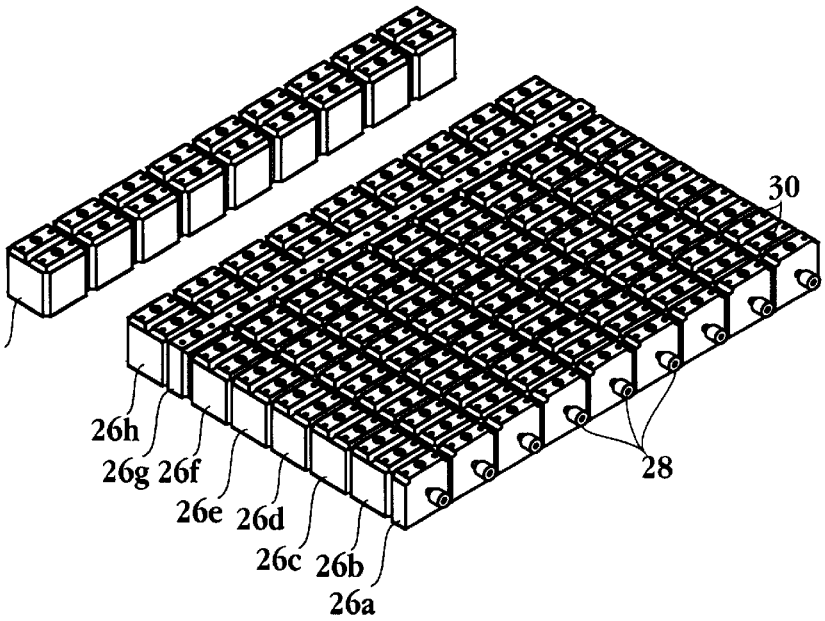
FIG. 6A is a perspective view of a gas-manifold panel constructed in accordance with an embodiment of the present invention.

The exploded view of FIG. 2 shows additional details of the gas panel apparatus of FIG. 1. The gas-manifold panel 10, of the illustrated gas panel apparatus, is comprised of a plurality of individual blocks 26. The blocks 26 may be formed from any suitable material, such as a metal or a metal alloy. The various views of FIGS. 3–5 show three respective embodiments of individual blocks 26 which are suitable for use in constructing the gas-manifold panel 10. The blocks of FIGS. 3 and 4 are substantially cubical, while the block of FIG. 5 is elongated. As best seen in the perspective and top plan views of FIGS. 6A and 6B, a plurality of cubical blocks are positioned side-by-side to form several rows (26*a*–26*f*, and 26*h*–26*i*). The rows, in turn, are disposed alongside one another. Elongated blocks may be used as well, such as the block 26 shown in FIG. 5A. An elongated block forming a portion of a gas-manifold panel 10 is denoted by the reference numeral 26*g* in FIGS. 6A and 6B.

Although not illustrated in the figures, an alternative embodiment of the invention contemplates an entirely unitary gas-manifold panel, formed from a single block of material.

As best seen in FIGS. 3–5, a network of process-gas channels 30 extend through portions of the blocks 26 comprising the gas-manifold panel 10. The channels 30 may be formed by drilling directly into each block 26. The channels 30 define flow pathways permitting process gas movement within the panel 10. As shown in the figures, the channels 30 have inlet/outlet portions located along the upper surfaces of the blocks 30 which allow process gas to flow between the blocks 26 and the various gas-manifold components 12–18 mounted thereon.

Process-gas line connections 28, shown in FIGS. 1, 2, 6, 7 and 8, are located along an edge of the gas-manifold panel 10. Each of the connections 28 is suitable for receiving process gas from a source gas line. For example, process-gas lines (not shown) may extend from a storage tank and attach to one or more connection points 28.

Process-gas may be directed out of, and away from, the gas-manifold panel toward another location, such as a semiconductor wafer processing station (not shown), by attaching a gas line to one or more exposed inlet/outlet connection points.

The gas-panel components 12–18 may be of any type useful for monitoring process gas flow and/or achieving the desired characteristic(s) of process gas flow. For example, and without limitation, valves, filters, mass flow controllers, pressure transducers, and related components, may be mounted upon the surface of the panel 10. Mounting holes 32, best seen in FIGS. 2–5, extend into each block 26 for the purpose of receiving mounting/aligning screws (not shown) protruding through each gas-panel component 12–18. As indicated above, the gas-panel components 12–18 are placed in a manner permitting them to communicate with the gas flowing through the channels 30 of the various blocks 26.

Figure 8:
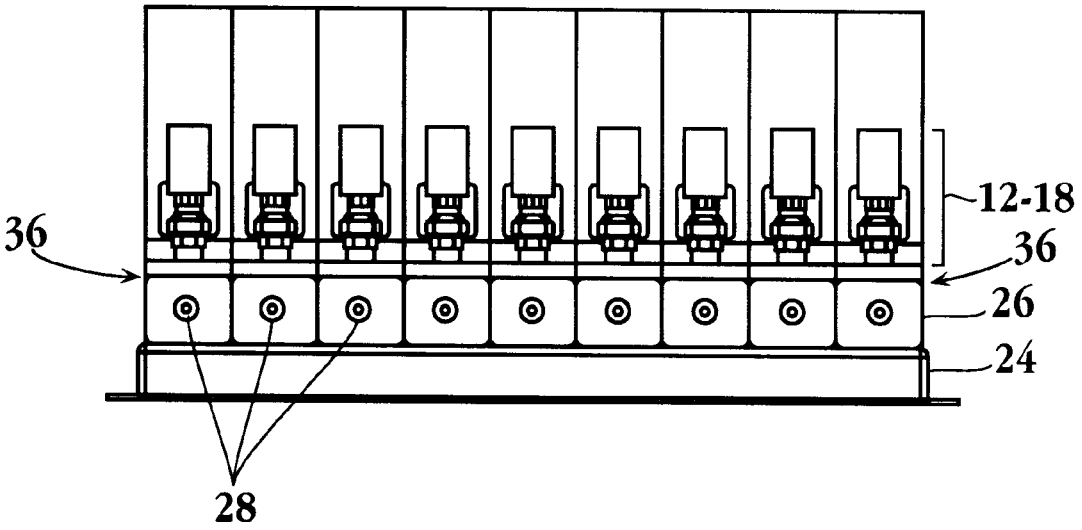
FIG. 8 is a front elevational view of the gas panel apparatus depicted in FIG. 1.

With additional reference to the front elevational view of FIG. 8, a surface interface 36 is defined generally by the meeting of an upper surface of the gas-manifold panel 10 with a lower surface of each of the gas-manifold components 12–18. The surface interface 36 is a two-dimensional expanse having a perimeter which extends outward as far as the outermost edges of the gas-manifold panel 10 and gas-manifold components 12–18.

Figure 9A:
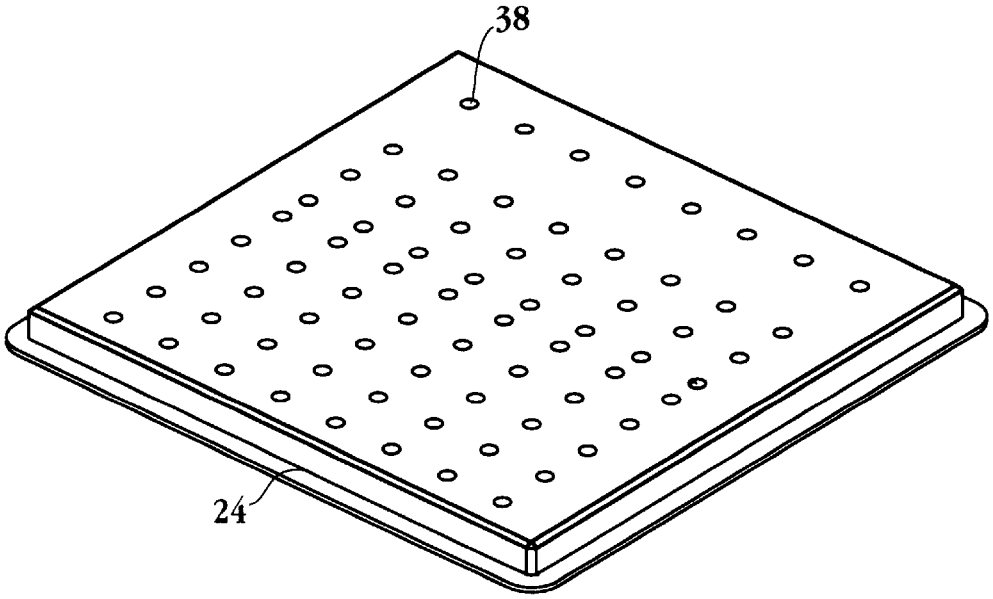
FIG. 9A is a perspective view of a plenum suitable for use in connection with the gas-manifold panel of the invention.
Figure 9B:
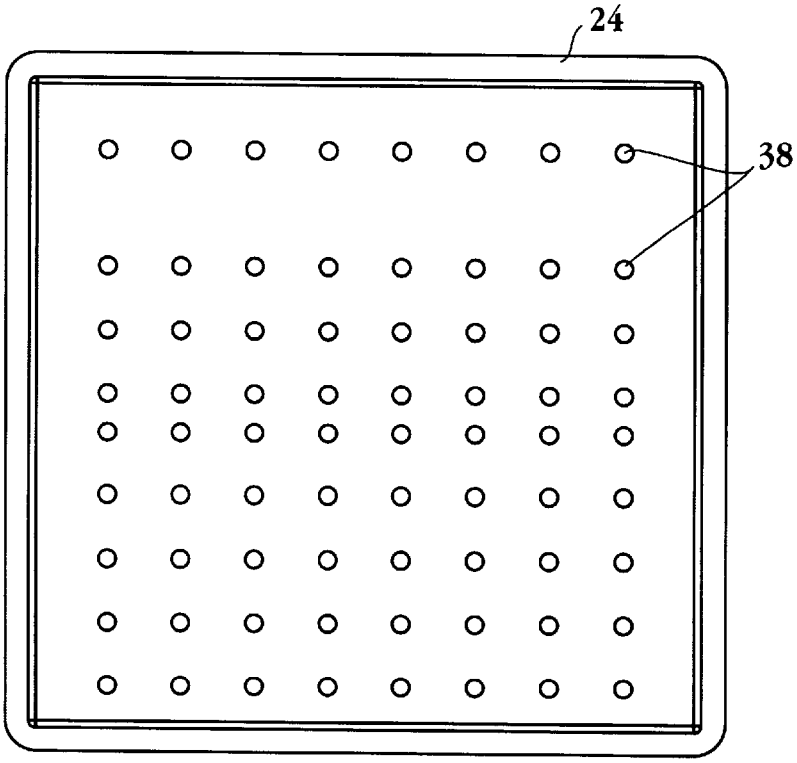
FIG. 9B is a top plan view of the plenum of FIG. 9A.
Figure 9C:
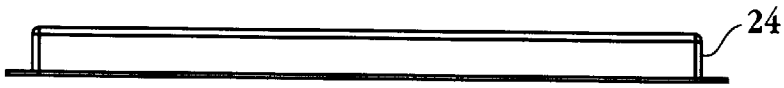
FIG. 9C is a side elevational view of the plenum of FIG. 9A.

As described previously, a plenum 24 is disposed adjacent a lower surface of the gas-manifold panel 10. Details of the plenum 24 are shown in FIGS. 9A–9C. The plenum 24 is provided with a plurality of venting holes 38 traversing one surface. The venting holes 38 allow gas to pass in or out of the plenum 24. As best seen in FIG. 2, the venting holes 38 are provided on a surface of the plenum 24 which lies closest to the gas-manifold panel 10.

As contemplated herein, the gas panel apparatus should be enclosed within a secondary confinement structure (not shown). The gas panel may be held within the secondary confinement using any suitable mounting means. The secondary confinement aids in containing process gas which might leak from the apparatus.

Furthermore, a stream of purging gas should be directed along a pathway extending over the gas-manifold components 12–18 and the surface interface 36. This stream of purging gas, which aids in scavenging leaked process gas, can then be evacuated from the secondary confinement and directed to a location where it cannot cause substantial harm.

In addition to the above, the present invention provides structure for directing a flow of purging gas along a pathway which intersects and passes through the surface interface 36. Such structure allows for a more complete scavenging of leaked process gas as compared to the scavenging capabilities of previously known integrated gas panel systems.

In this latter regard, conduit structure is formed in the gas-manifold panel 10. The conduit structure of the invention helps to define a purging gas pathway which extends from an area above the surface interface 36 into the gas-manifold panel 10. Following this pathway, purging gas passes through the surface interface 36.

As shown in FIGS. 3B, 3D, 5B, and 5D, suitable conduit structure 40 may comprise cylindrical passages fully traversing the panel blocks 26 from top to bottom. Conduit structure 40 of this type may be formed by drilling a hole through the panel blocks 26.

Figure 4A:
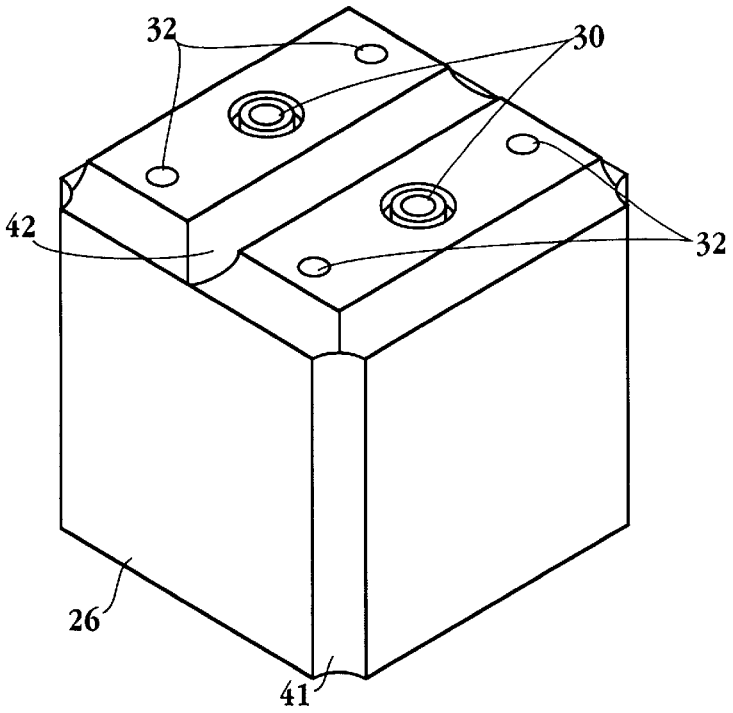
FIG. 4A is a perspective view showing another embodiment of an individual panel block which is suitable for use in constructing the gas-manifold panel of the present invention.
Figure 4B:
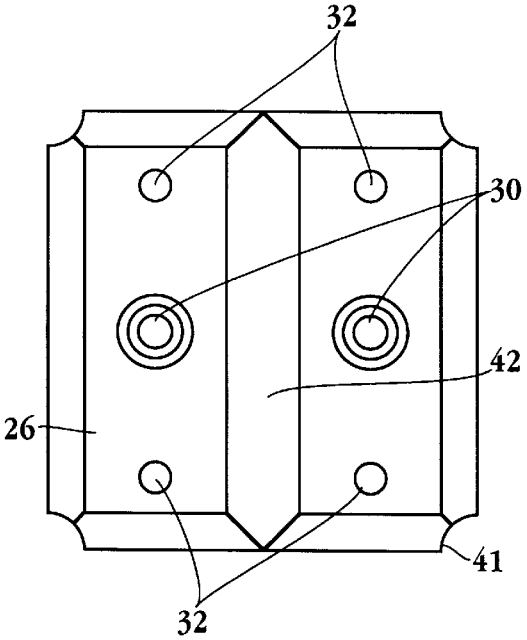
FIG. 4B is a top plan view of the individual panel block shown in FIG. 4A.
Figure 4C:
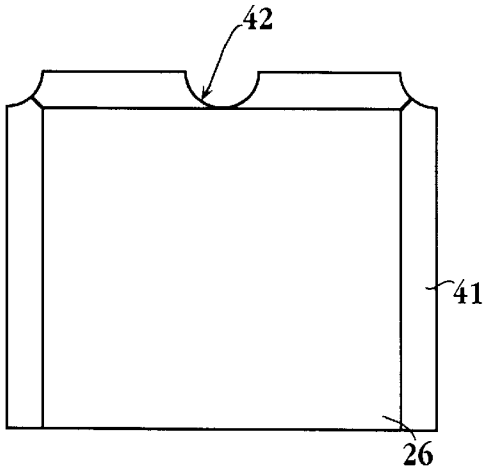
FIG. 4C is a side elevational view of the individual panel block shown in FIGS. 4A and 4B.
Figure 5A:
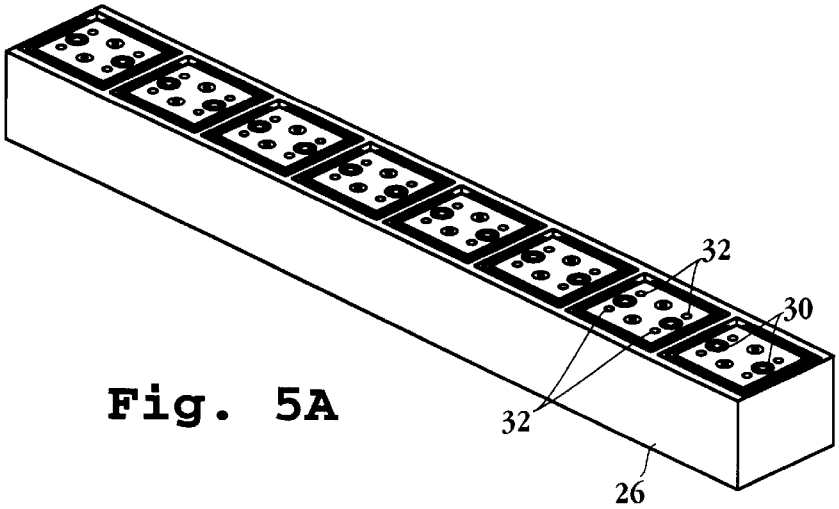
FIG. 5A is a perspective view showing still a further embodiment of an individual panel block which is suitable for use in constructing the gas-manifold panel of the present invention.
Figure 5B:
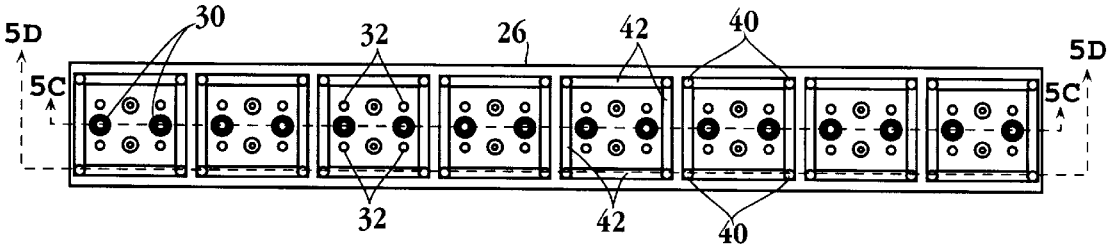
FIG. 5B is a top plan view of the individual panel block shown in FIG. 5A.
Figure 5C:
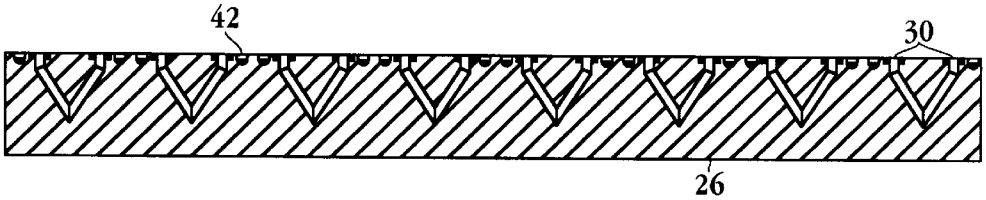
FIG. 5C is a cross-sectional view taken along the line A—A of FIG. 5B.
Figure 5D:
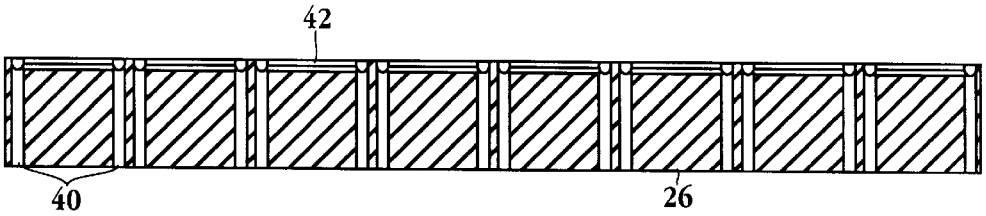
FIG. 5D is a cross-sectional view taken along the line B—B of FIG. 5B.
Figure 6B:
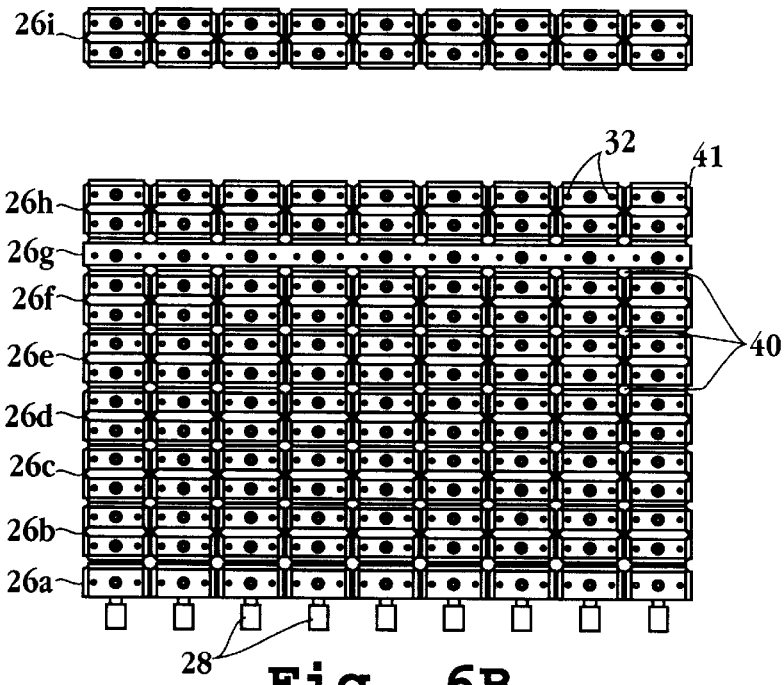
FIG. 6B is a top plan view of the gas-manifold panel of FIG. 6A.
Figure 6C:
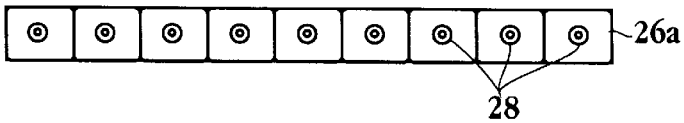
FIG. 6C is a front elevational view of the gas-manifold panel of FIG. 6A.
Figure 7:
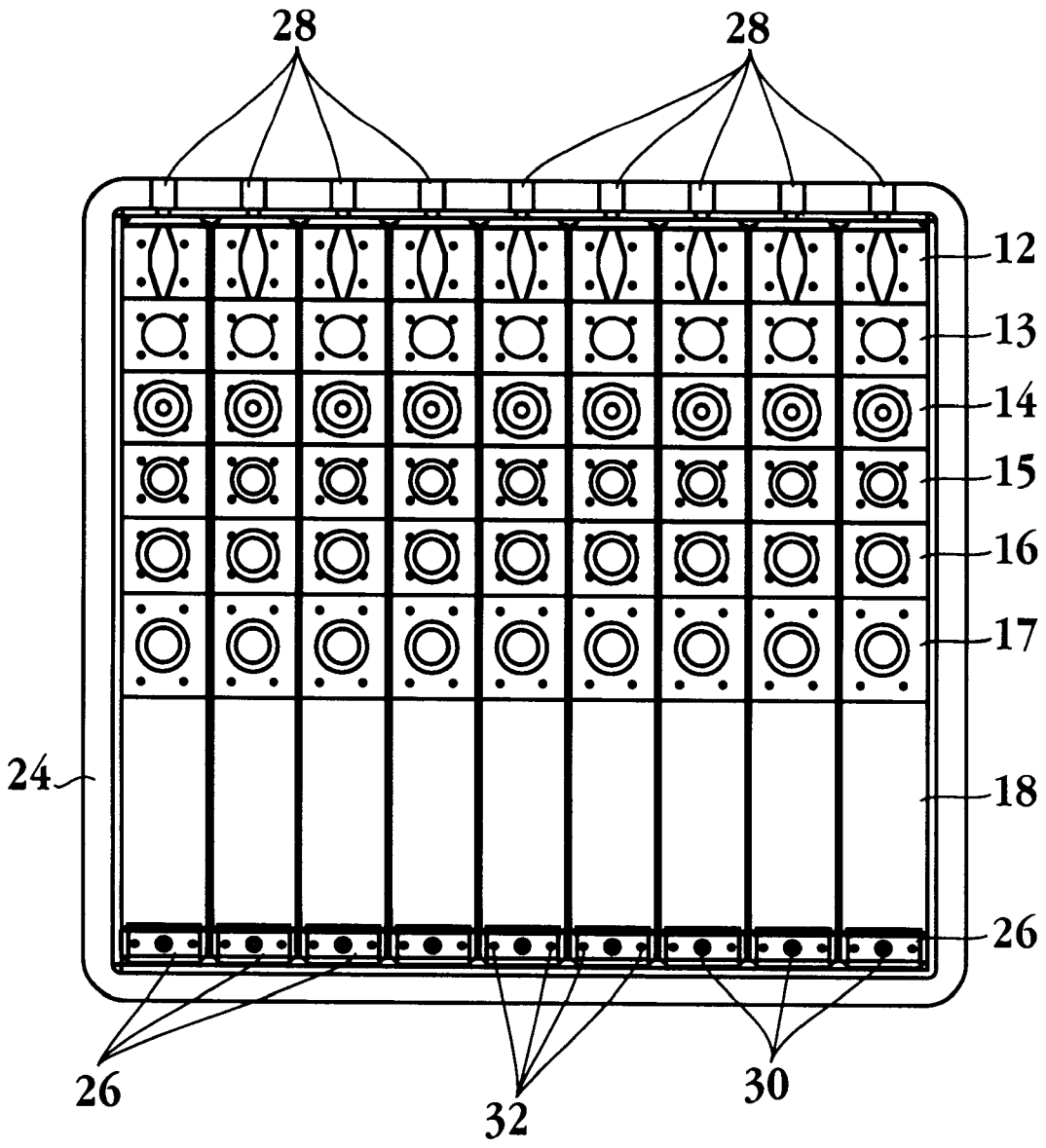
FIG. 7 is a top plan view of the gas panel apparatus shown in FIG. 1.

In another embodiment, depicted in FIGS. 4A–4C, and in FIG. 6B, suitable conduit structure 40 may be formed by way of quarter-circle slots 41 provided along each vertically extending lateral edge of the panel blocks 26. Upon arranging four or more such slotted panel blocks 26 together as shown in FIG. 6B, the slots 42 combine to form a cylindrical conduit 40.

By aligning the central axes of the conduits 40 through the gas-manifold panel 10 with the central axes of the venting holes 38 through the plenum 24, fluid communication can be established between the area above the surface interface 36 and the internal area of the plenum structure 24.

Purging gas can be induced to move downward through the surface interface 36 and into the plenum 24 by generating a negative pressure within the plenum 24. For example, a pump (not shown) may be used to evacuate the plenum 24. The evacuation of the plenum 24, in turn, serves to pull purging gas past the surface interface 36. Any leaking process gas at the surface interface 36 is entrained by the flow of purging gas and carried downward through the conduit structure 40 and into the internal area of the plenum 24. The leaked gas is then directed out of the secondary confinement to a place where it will not cause substantial harm.

An advantage of directing the purging gas through the surface interface 36 and into a plenum 24 behind the gas-manifold panel 10 is that the purging gas and entrained process gas will not escape from the secondary confinement structure when the confinement structure's door is opened, for example, during inspection or servicing.

Alternatively, purging gas can be induced to move out of the plenum 24 and through the surface interface 36 by generating a positive pressure within the plenum 24. For example, a pump (not shown) may be used to pressurize the plenum 24. Pressurization of the plenum 24, in turn, serves to push purging gas upward, past the surface interface 36. Any leaking process gas at the surface interface 36 is entrained by the upward flow of purging gas. Once across the surface interface, the mixture of purging gas and leaked-process gas then joins the flow of purging gas passing across the surface interface. These gases are then directed out of the secondary confinement to a place where they will not cause substantial harm.

Although not illustrated in the figures, an alternative embodiment of the invention contemplates, instead of a plenum 10, a reservoir formed within the gas-manifold panel 10. In this alternative construction, the conduit structure 40 defines a portion of a purging-gas pathway which extends, not to a location beneath the gas-manifold panel as in the previously described embodiment, but rather into the reservoir which is internal to the gas-manifold panel. The reservoir can be evacuated or pressurized, as desired, to induce a scavenging flow of purging gas, in a manner like that described above.

One such alternative embodiment, having a purging-gas pathway which extends into a reservoir which is internal to the gas-manifold panel, contemplates a solid gas-manifold panel with integral scavenging. Specifically, a plurality of exhaust passages for carrying scavenging gas run coextensively with process gas pathways through a solid (unitary) gas-manifold panel member. Exhaust conduits for carrying scavenging gas run from the surface interface to the integral exhaust passages.

Another such alternative embodiment, having a purging-gas pathway which extends into a reservoir which is internal to the gas-manifold panel, contemplates several elongated gas-panel blocks, also referred to as gas sticks, arranged alongside one another to form a gas-manifold panel. Here, integral scavenging can take place by way of exhaust passages extending lengthwise through the gas sticks. Exhaust conduits for carrying scavenging gas extend from the surface interface to the integral exhaust passages.

Any gas typically used as a purging gas in known integrated gas panel systems, such as air or nitrogen, may be used in connection with the apparatus of the present invention.

In addition to the conduit structure 40 just described, other conduit structure may be provided in the gas-manifold panel 10, as well. For example, several of the figures show conduit structure 42 formed in, and extending across, an upper portion of the gas-manifold panel 10. This latter conduit structure 42 provides a pathway for the flow of purging gas over the gas-manifold panel. Preferably, the horizontal conduit structure 42 should direct purging gas to or from the purging-gas pathway extending through the surface interface 36 and the conduit structure 40.

A preferred pattern of purging gas flow is indicated by the darkened arrows (accompanied by the designation "air flow") in FIG. 2. As shown, the purging gas flows over the gas-manifold panel 10, through the surface interface 36 and into the gas-manifold panel 10. As shown, from the gas-manifold panel 10, the purging gas then flows into the plenum 24.

Another aspect of the invention provides a method of removing process gas leaking from an integrated gas panel system for delivering process gas to a semiconductor processing equipment location. The method should prove to be particularly advantageous when used in connection with an apparatus as described above.

As with the apparatus of the invention, the method is intended for use in connection with an integrated gas panel system for delivering process gas to a tool location. The method is particularly useful in the context of controlling the high-purity gases used in the processing of semiconductor devices. As discussed below, the method permits the efficient removal of process gas leaking along a surface interface whereat gas-manifold components meet the surface of a gas-manifold panel.

Specifically, and with reference to the accompanying figures, the method is intended for use in connection with an integrated gas panel system which includes a containment enclosure (not shown) and a gas-manifold panel 10 mounted within the containment enclosure, wherein the gas-manifold panel is provided with a network of process-gas channels 30 allowing the panel 10 to participate in the carrying of the process gas. The integrated gas panel system further including gas-manifold components 12–18 mounted upon the gas-manifold panel 10, and a surface interface 36 whereat the gas-manifold components 12–18 meet the gas-manifold panel 10.

The method comprises the step of simultaneously directing a stream of purging gas along a pathway extending over the surface interface 36 and along a pathway which intersects and passes through the surface interface 36.

A preferred pattern of purging gas flow, which may be achieved by way of the method described herein, is indicated by the darkened arrows (accompanied by the designation "air flow") in FIG. 2. As shown, the purging gas is caused to flow over a gas-manifold panel 10, through a surface interface 36, and into the gas-manifold panel 10. Leaked process gas residing along the surface interface 36 is entrained by the purging gas flow and carried away to a location where it cannot cause significant harm.

A plenum 24 located along one surface of the gas-manifold panel, as depicted in FIGS. 1–2, or a reservoir (not shown) formed in the gas-manifold panel 10, disposed in fluid communication with the area above the surface interface 36, may be pressurized or evacuated, as desired, in order to induce the flow of purging gas over and through the surface interface. Pressurization or evacuation may be effected by way of a pump (not shown).

Those skilled in the art can now appreciate from the foregoing description that the broad teachings of the present invention can be implemented in a variety of forms. Therefore, while this invention has been described in connection with particular embodiments and examples thereof, the true scope of the invention should not be so limited. Various changes and modification may be made without departing from the scope of the invention, as defined by the appended claims.

It is claimed:

1. An integrated gas panel system for delivering process gas to a tool location, comprising:

a containment enclosure, a gas-manifold panel, comprising a plurality of gas-manifold panel blocks, each comprising at least one process-gas channel, mounted within said containment enclosure, gas-manifold components mounted upon said gas-manifold panel blocks, a surface interface whereat said gas-manifold components meet said gas-manifold panel blocks, and a chamber, wherein process gas leaking from said gas-manifold components is removed by directing a stream of purging gas along a pathway extending over said surface interface, and wherein each said block defines conduit structure for directing said purging gas to or from the chamber, along a pathway which intersects and passes through said surface interface.

2. The apparatus of claim 1, further comprising a pressure control source, in communication with said chamber, operable to change the gas pressure in said chamber.

3. The apparatus of claim 2, wherein said pressure control source is operable to evacuate the chamber.

4. The apparatus of claim 2, wherein said pressure control source is operable to pressurize the chamber.

5. The apparatus of claim 1, wherein said chamber is a plenum adjacent said panel.

6. The apparatus of claim 1, wherein said chamber is a reservoir formed in said panel.

7. A method of removing process gas leaking from an integrated gas panel system, where said system includes a containment enclosure, a gas-manifold panel, comprising a plurality of gas-manifold panel blocks, each comprising at least one process-gas channel, mounted within said containment enclosure, gas-manifold components mounted upon said gas-manifold panel blocks, and a surface interface whereat said gas-manifold components meet said gas-manifold panel blocks, wherein each said block defines conduit structure for directing a purging gas to or from the chamber, along a pathway which intersects and passes through said surface interface, the method comprising:

simultaneously directing a stream of purging gas along a pathway extending over said surface interface and along said pathways which intersect and pass through said surface interface.

8. The method of claim 7, wherein said purging gas is moved through said conduit by changing the gas pressure at one end of said conduit.

9. The method of claim 8, wherein the gas pressure at one end of said conduit is changed by evacuating a chamber which is disposed in fluid communication with said conduit.

10. The method of claim 9, wherein said chamber is a plenum adjacent said panel.

11. The apparatus of claim 9, wherein said chamber is a reservoir formed in said panel.

12. The method of claim 8, wherein the gas pressure at one end of said conduit is changed by pressurizing a chamber which is disposed in fluid communication with said conduit.

13. The method of claim 12, wherein said chamber is a plenum adjacent said panel.

14. The method of claim 12, wherein said chamber is a reservoir formed in said panel.

15. An integrated gas panel system for delivering process gas to a tool location, comprising:

a containment enclosure, mounted within said containment enclosure, a gas-manifold panel formed of a single unitary gas-manifold panel member, comprising a plurality of process gas channels and a plurality of integral exhaust passages;

gas-manifold components mounted upon said gas-manifold panel, a surface interface whereat said gas-manifold components meet said gas-manifold panel, a reservoir within said gas-manifold panel member, disposed in fluid communication with an area above the surface interface, and a plurality of exhaust conduits, running from the surface interface to said plurality of integral exhaust passages within said gas-manifold panel member, effective to direct a purging gas from said surface interface to the reservoir.

16. A method of removing process gas leaking from an integrated gas panel system, where said system includes:

a containment enclosure, a gas-manifold panel formed of a single unitary, gas-manifold panel member, comprising a plurality of process gas channels and a plurality of integral exhaust passages, mounted within said containment enclosure;

gas-manifold components mounted upon said gas-manifold panel, a surface interface whereat said gas-manifold components meet said gas-manifold panel, a reservoir within said gas-manifold panel member, disposed in fluid communication with an area above the surface interface, and a plurality of exhaust conduits, running from the surface interface to said plurality of integral exhaust passages within said gas-manifold panel member, effective to direct a purging gas from said surface interface to the reservoir;

the method comprising:

evacuating or pressuring said reservoir to induce a scavenging flow of purging gas.

* * * * *